US007101504B2

(12) United States Patent
Suzuki

(10) Patent No.: US 7,101,504 B2
(45) Date of Patent: Sep. 5, 2006

(54) HIGHLY ORIENTED SUPER MICROFILAMENTS

(75) Inventor: Akihiro Suzuki, Kitakoma-gun (JP)

(73) Assignee: Yamanashi TLO Co., Yamanashi (JP)

( * ) Notice: Subject to any disclaimer, the term of this patent is extended or adjusted under 35 U.S.C. 154(b) by 0 days.

(21) Appl. No.: 10/528,039

(22) PCT Filed: Mar. 7, 2003

(86) PCT No.: PCT/JP03/02727

§ 371 (c)(1),
(2), (4) Date: Mar. 16, 2005

(87) PCT Pub. No.: WO2004/027133

PCT Pub. Date: Apr. 1, 2004

(65) Prior Publication Data

US 2006/0006585 A1 Jan. 12, 2006

(30) Foreign Application Priority Data

Sep. 17, 2002 (JP) ..... 2002-307633

(51) Int. Cl.
*D01F 6/00* (2006.01)
*B29C 35/08* (2006.01)
*B65H 54/64* (2006.01)

(52) U.S. Cl. ..... 264/481; 428/364; 28/289; 242/366; 226/108; 226/97.4

(58) Field of Classification Search ..... 428/364; 264/481; 28/289; 226/108, 97.4; 242/366
See application file for complete search history.

(56) References Cited

U.S. PATENT DOCUMENTS 6,210,622 B1 * 4/2001 Reese et al. ..... 264/481
6,497,952 B1 12/2002 Ohkoshi et al.

FOREIGN PATENT DOCUMENTS

| | | |
|---|---|---|
| JP | 49-081621 | 8/1974 |
| JP | 60-24852 | 2/1994 |
| JP | 7-258940 | 10/1995 |
| JP | 11-021737 | 1/1999 |
| JP | 2000-290823 | 10/2000 |
| JP | 2002-220740 | 8/2002 |
| JP | 2003-166115 | 6/2003 |

OTHER PUBLICATIONS

Pg. 105 Polymer Preprints, Japan vol. 50, No. 4 (2001), p. 787 Mechanical Properties and Microstructure of PET Fibers obtained by Laser-Heating Zone-Drawing [III] Akihiro Suzuki and Noriaki Mochiduki, Faculty of Engineering, Yamanashi University.
Pg. 106 Polymer Preprints, Japan vol. 50, No. 4 (2001), p. 787 Application of High Power CO2 Laser-heating Zone-drawing to PET Fibers Akihiro Suzuki and Noriaki Mochiduki, Faculty of Engineering, Yamanashi University.

* cited by examiner

*Primary Examiner*—N. Edwards
(74) *Attorney, Agent, or Firm*—Jordan and Hamburg LLP

(57) ABSTRACT

Method of and apparatus for continuously manufacturing highly oriented super micro filaments with a diameter of 5 μm or less from most of thermoplastic polymers stably by a simple and convenient means without requiring any special apparatus of high accuracy and high level, characterized in original filaments supplied from a filament supply means are heated by infrared beams and the heated filaments are drawn by tension provided by their own weight or under an applied tension of 1 MPa or less, and are drawn to 1000 times or more.

18 Claims, 9 Drawing Sheets

Fig. 7

| | | Supplying speed | Winding speed | | | | |
|---|---|---|---|---|---|---|---|
| | rpm | | 1000 | 2000 | 3000 | 4000 | 4900 |
| | | m/m | 283 | 565 | 848.2 | 1131 | 1386.9 |
| Diameter (μm) | 2 | 0.30 | 6.534 | 4.472 | 3.66 | 3.47 | 2.74 |
| | 3 | 0.45 | 7.611 | 5.867 | 5.15 | 3.71 | 3.43 |
| | 4 | 0.60 | 9.502 | 6.82 | 5.43 | 4.68 | 4.53 |
| | 5 | 0.75 | 9.9 | 7.682 | 6.11 | 5.01 | 4.66 |
| | 11 | 1.66 | 16.17 | 11.814 | 10.389 | 8.044 | 7.458 |
| Birefringence ×1000 | 2 | 0.30 | 12.371 | 8.21 | 20.715 | 27.858 | 59.541 |
| | 3 | 0.45 | 7.186 | 14.095 | 10.941 | 29.873 | 37.975 |
| | 4 | 0.60 | 10.503 | 9.791 | 11.379 | 14.228 | 20.063 |
| | 5 | 0.75 | 7.329 | 9.212 | 13.667 | 11.33 | 19.11 |
| | 11 | 1.66 | 2.927 | 3.343 | 6.914 | 8.814 | 11.402 |
| Power density ($W/cm^2$) | 2 | 0.30 | 17.5 | 17.5 | 18.3 | 18.3 | 19.1 |
| | 3 | 0.45 | 22.3 | 23.1 | 23.9 | 23.9 | 26.3 |
| | 4 | 0.60 | 87.6 | 13.2 | 128.7 | 94.1 | 82.7 |
| | 5 | 0.75 | 0.0 | 0.0 | 0.0 | 0.0 | 0.0 |
| | 11 | 1.66 | 15.9 | 2.4 | 98.5 | 65.4 | 164.9 |

HIGHLY ORIENTED SUPER MICROFILAMENTS

1. TECHNICAL FIELD OF THE INVENTION

This invention concerns a method of and an apparatus for manufacturing drawn filaments and it also relates to highly oriented super microfilaments drawn at a high draw ratio of 1000 times or more and obtained by the drawing method.

2. BACKGROUND ART

Super microfilaments have been used in various applications such as artificial leathers, wiping cloths or filters. However, since special and complicate spinning methods such as islands-in-a-sea type fiber spinning (for example, Japanese Patent Laid-Open No. Hei 7-258940) or spinning by dividual fibers (for example, Japanese Patent Laid-Open No. 2002-220740) have been used, for the production of highly oriented super micro filaments and having high quality with the filament diameter of 5 μm or less, they are expensive and cannot be drawn simply and conveniently by using general-purpose fibers.

On the other hand, as a method of obtaining fibers of high tensile strength and high tensile modulus, the present inventors, et al. have proposed a zone drawing method (Japanese Patent Publication No. Sho 60-24852), but further requirements are desirable for stable production of fine filaments by the zone drawing. Further, while the present inventors have already disclosed a prior invention for the method of obtaining super micro filaments (Japanese Patent Application No. 2001-353781), it has been found that further requirements are desirable for obtaining stable super micro filaments continuously.

3. DISCLOSURE OF INVENTION

This invention provides means for drawing original filaments. The original filaments in this invention may be already manufactured as filaments and wound-up on bobbins or the like, or filaments to be the material for the drawing means in this invention which are formed into filaments from molten or dissolved filaments by cooling or coagulation in the spinning process, and used successively in the spinning process. The filament referred to herein is a substantially continuous filament which is distinguished from short fibers having a length of several millimeters to several tens millimeters. While the original filaments are preferably exist individually, those filaments can be used even if gathered by the number of several or several tens.

For the original filament of this invention, any of filaments consisting of thermoplastic polymers such as polyesters including polyethylene terephthalate, polyamide including nylon (including nylon 6, nylon 66), polyolefins including polypropylene and polyethylene, polyvinyl alcohol polymers, acrylonitrile polymers, fluoro polymers, vinyl chloride polymers, styrene polymers, polyoxymethylene and ether ester polymers, can be used. Among them, polyethylene terephthalate, nylon (including nylon 6 and nylon 66) and polypropylene have good drawability and molecular mobility, and are particularly suitable for the drawing of this invention.

Drawing of this invention is applied to the original filaments supplied from means for delivering filament. Various types of supply means can be used so long as they can deliver the filaments at a constant supplying speed, such as nip rollers or rotational rollers.

Original filaments supplied by the filament supply means are preferably further sent through the blowing duct by way of a gas flowing in the running direction of the original filaments. The gas at a room temperature is usually used for the gas flowing through the blowing duct, but heated air is used in a case of intending to preheat the original filaments. Further, for preventing the original filaments from oxidation, an inert gas such as a nitrogen gas is used, and in case of preventing scattering of water, gas containing water vapor or water is used. The blowing duct shall not necessarily be tube form but may be of a grooved shape so long as the original filaments flow together with the gas through the duct. The cross section of the duct is preferably circular but may be rectangular or other shape. The gas flowing through the duct may be supplied from one of branched, or may be supplied from an outer pipe to an inner pipe through apertures or the like in the case of using a double walled duct. An air-jet interlacing nozzle for filaments used for interlace spinning or Taslan fabrication of synthetic fibers is also used for the blowing duct in this invention.

A guiding tool for controlling the position of the filaments is preferably disposed at the exit of the blowing duct. The original filaments leaving the blowing pipe are drawn under heating by infrared beams but characterizes in the heating is conducted within an extremely narrow range. The guiding tool for controlling the position of the filaments is disposed so as to enable heating in the narrow range. While such function can be provided by the shape of the exit of the blowing duct, it is preferred that the blowing duct focus on the flowing of gas delivering the filaments and the easiness for the passing the filaments, and after that the position of the filament are restricted by a simple and convenient guiding tool. As the guiding tool, a narrow duct or groove, a comb or a combination of fine bars may be used.

The original filaments leaving the blowing pipe are heated to an appropriate drawing temperature by an infrared heating means including laser). Infrared rays heat the original filaments but characterizes in that the heating range to an appropriate drawing temperature is within a range of 8 mm or less, preferably 5 mm or less, most preferably 3 mm or less. This invention makes it possible the drawing accompanying high molecular orientation by extremely drawing in the narrow range and that enabled the decrease of breakage at drawing even in the super high draw ratio. The wavelength of the infrared rays is said to be from 0.78 μm to 1 mm but a near infrared region about from 0.78 μm to 20 μm centering on the absorption at 3.5 μm for C—C bonds of the polymeric compound is particularly preferred. For the infrared rays, heating heaters referred to a spot heater or a line heater of narrowing the focal point into a line or spot shape by a mirror or a lens thereby narrowing the heating area for the filaments to 8 mm or less can be used. Particularly, the line heater is suitable in a case of heating plural filaments simultaneously.

For the infrared heating in this invention, laser heating is particularly preferred. Among all, a carbon dioxide gas laser with a wavelength of 10.6 μm and a YAG (Yttrium-Aluminum-Garnet series) laser with a wavelength of 1.06 μm are particularly preferred. Since the laser can restrict the radiation range smaller and as the energy is concentrated to a specified wavelength, wasteful energy is decreased. The carbon dioxide gas laser of this invention has a power density of 15 W/cm$^2$ or more, preferably 20 W/cm$^2$ or more and most preferably 30 W/cm$^2$ or more. This is because the super high ratio drawing of this invention is enabled by concentrating the high power density energy to a narrow drawing region.

Generally, drawing is conducted by heating filaments or the like to an appropriate drawing temperature and applying a tension thereon. The applied tension in drawing of this invention, characterized in that drawing is conducted by the tension provided by the own weight of filaments. This is different in the principle, from usual drawing where drawing is conducted by a tension provided by the difference of speeds between the rollers and by the tension caused by wind-up. In this invention, an optimal applied tension can be selected by changing the own weight of the filaments applied to the heated portion (determined depending on the free failing distance from the heated portion) by the change of the free falling distance. In the usual drawing between rollers, it is difficult to control the draw ratio as large as 1000 times or more. It is a feature of this invention that the ratio can be controlled easily by a simple and convenient means of distance.

Further, drawing is conducted also by setting the applied tension to an extremely reduced level, preferably 1 MPa or lower, further preferably 0.3 MPa or lower and, most preferably 0.1 MPa or lower. If the applied tension exceeds 1 MPa, breakage at drawing is liable to occur and the range of the applied tension as described above is preferred for drawing at a high ratio. It is considered that drawing at an extremely high draw ratio of 1000 times or more can be attained with such a small drawing tension, because the drawing is conducted within an extremely narrow drawing region while keeping an extreme high drawing temperature of the melting point or thereabout, so that the filaments can be deformed with no breakage. In the usual drawing for synthetic fibers between rollers, the fibers are drawn at an applied tension of 10 MPa to 100 MPa. The feature of this invention resides in drawing within a range greatly different therefrom.

In this invention, it is characterized that the filaments are drawn at a super high ratio of the obtained drawn filament as 1000 times or more, preferably 2000 times or more, further preferably 5000 times or more and most preferably 10000 or more. Considering that the draw ratio of usual synthetic fiber is 3 to 7 times, and even in the super drawing of PET fibers, it is about ten and several times, this invention has a feature in that drawing can be conducted at a super high ratio of 100 times or more of the state of the art drawing. The invention has a feature in that drawing within an extremely narrow zone is enabled and, accordingly, the drawing temperature can be increased to the melting point or thereabout of the original filament which decreases the drawing tension, and that means capable of controlling the small drawing tension and the super high ratio has been found. Since the drawing at the super high ratio is possible, this enables manufacture of super micro filaments with a diameter of 10 μm or less, further 5 μm or less and further 3 μm or less, as well as can increase the production speed for the manufacture of filaments to several hundred times, which is significant also in view of the productivity. The invention has a feature that the filaments are drawn with an swelled portion larger than the original filament diameter at the drawing start point in a case where the starting filament has a degree of orientation of 30%, preferably 50% or more when measured in the birefringence. Such a peculiar phenomenon has no yet been observed in usual drawing for synthetic fibers. It is considered that the phenomenon is derived from that the drawing temperature is increased to the melting point or thereabout of the original filaments and drawing in a narrow zone is enabled. As described above, while the original filaments having the degree of orientation to some extent can be drawn only by twice or three times in usual drawing, drawing at a ratio of 10 times or more to several thousands times or more is possible in a case of drawing with the swelled portion, and even drawing at a ratio of 10,000 times or more is also possible by selecting conditions. In this case, the original filaments already molecular orientated may be those obtained by usual drawing or may be those molecular orientated in the spinning stage of high speed spinning or the like. The original filaments obtained by the zone drawing method are preferred with a viewpoint of increasing the degree of molecular orientation of the final drawn filaments.

The degree of orientation f when measured with the birefringence of the original filament in this invention is represented by the following equation. While compensation for density is necessary in the equation, it is troublesome and calculation is performed while neglecting the compensation.

$$f(\%)=(\Delta n/\Delta n^0_c)\times 100$$

Where, Δn is a birefringence obtained by actual measurement and $\Delta n^0_c$ represents an intrinsic birefringence of crystalline region, which is determined based on theoretical value. While the values cannot always agree, those values often used generally are 0.24 for polyethylene terephthalate, 0.096 for nylon 6 or nylon 66 an d0.042 for isotactic polypropylene. Also, this invention is able to obtain highly oriented super micro filaments. The highly molecular oriented filaments preferably have a degree of orientation of 20.8% in view of birefringence. Further, the draw ratio λ in this invention is represented by the following equation based on the diameter $d_0$ for the original filament and the diameter d for the filament after drawing. In this case, calculation is performed assuming the density of the filament as constant. The diameter measurement is conducted by a scanning electron microscope (SEM) based on photograph taken at 350× for the original filament and at 1000× for the drawn filament, with respect to average values of 10 points.

$$\lambda=(d_0/d)^2$$

The drawn filaments in this invention are wound-up around a bobbin or cheese into products in the form of bobbin-wound on cheese-wound products. In the wound-up process, the drawn filaments are preferably wound-up while being traversed. This is because uniformly wound-up form can be ensured by traversing. In the super microfilaments, occurrence of breakage of filament or of fluff results in a most significant problem. In this invention, since the filament is highly molecular orientated and the drawing tension is small, the filament can be wound-up wit a small winding tension, it is characterized in also enabling the decrease of breakage of filament or fluff.

Subsequent to the drawing step of this invention, a heating device having a heating zone may be disposed to apply a heat treatment to the drawn filaments. Heating can be conducted by passing them through a heating gas, radiation heating such as infrared heating, passing them over a heating roller, or a combination of them. The heat treatment can provide various effects such as reduction of thermal shrinkage of the drawn filaments, increase in the degree of crystallization to decrease the aging change of the filaments or improve the Young's modulus. In the case of the non-woven fabric of this invention, the heat treatment may also be applied on a conveyor.

The drawn filaments of this invention can be wound-up after additional drawing. For the drawing in the subsequent step, drawing means used in the previous step can also be used. In a case where the filament has already been drawn at a sufficiently high ratio in the previous step and super micro filaments have already been obtained, inter-roller drawing such as by godet rollers or pin drawing may also be used.

Non-woven fabrics consisting of drawn filaments can be manufactured by accumulating drawn filaments in this invention on a running conveyor and it is significant that non-woven fabrics consisting of highly oriented super micro filaments can be manufactured simply and conveniently. In recent years, non-woven fabrics have been demanded vigorously in various fields taking notice on the characteristics peculiar to the non-woven fabrics not merely as substitutes for woven fabrics. Among them, non-woven fabrics of super micro fiber include melt blown non-woven fabrics which are prepared by blowing off molten filaments by a hot blow to form filaments of 3 μm or thereabout and then accumulating them on a conveyor to form non-woven fabrics. They are used mainly for air filters. However, filaments constituting the melt blown non-woven fabrics have lower strength than usual non-drawn fibers as 0.1 cN/dtex or thereabout, in which a number of small lumps of resins called as shots are present. The non-woven fabrics consisting of drawn filaments of this invention have a filament strength equal with or superior to that of usual drawn synthetic fibers and that do not contain shots at all while having a diameter of about 3 μm like the melt blown non-woven fabrics because the filaments are highly oriented. Non-woven fabrics usually requires any interlace or bonding between fibers. However, in this invention, since the diameter is extremely small, the number of filaments per unit weight is extremely increased and filaments are interlaced by vacuum suction below the conveyor and are often bonded sufficiently by simple pressing upon accumulation of filaments on the conveyor, with no particular bonding step like the melt blown non-woven fabric. Naturally, method such as thermal embossing, needle punching or adhesive bonding conducted in usual non-woven fabrics may also be used, which may be selected depending on the application use. In the filter usage as a major application use of super micro fiber non-woven fabrics, collecting efficiency can be increased outstandingly by applying an electrostatic treatment to the non-woven fabrics and the non-woven fabrics of this invention can also be applied by electrostatic treatment to the field of the filters. When filaments are accumulated on the conveyor in the manufacture of the non-woven fabrics of this invention, negative pressure is applied at the back of the conveyor and the flow of air under air suction by the negative pressure or flow of air by the positive use of an air sucker sometimes acts as a tension for drawing in the filament drawing, which is also included in the drawing tension of this invention.

In a case where the drawn filaments of this invention are nylon (nylon 6 or nylon 66), highly oriented super micro nylon filaments can be formed characterized in that the birefringence is $35\times10^{-3}$ or more, preferably $40\times10^{-3}$ or more and a diameter is 5 μm or less, more preferably 3 μm or less and most preferably 2 μm or less. Nylon has inherent feeling even when highly molecular orientated and is considered prospective in various application uses such as fabric filaments for garments having a peach-skin touch or automobile airbags.

In a case where the drawn filaments of this invention are polyethylene terephthalate, highly oriented super micro polyester filaments can be formed characterized in that the birefringence is $30\times10^{-3}$ or more, preferably $50\times10^{-3}$ or more and most preferably $150\times10^{-3}$ or more and a diameter is 5 μm or less, more preferably 3 μm or less and most preferably 2 μm or less. Since the polyester is inexpensive, and can be provided with high heat resistant, tensile strength and Young's modulus, it is used not only for garments but also in various industrial fields and, when they are formed into highly oriented super micro filaments, development in a further higher quality application use can be expected.

When the drawn filaments of this invention are isotactic polypropylene, highly molecular orientated super micro polypropylene filaments can be formed characterized in that the a birefringence is $20\times10^{-3}$ or more and, preferably $25\times10^{-3}$ or more and a diameter of 5 μm or less and, preferably 3 μm or less and most preferably 2 μm or less. Since polypropylene has water repellency and chemical resistance and has various properties such as easy to apply electrostatic treatment, when it is formed into highly oriented super microfilaments, development in various industrial application uses such as filters can be expected.

4. BRIEF DESCRIPTION OF THE DRAWING

FIG. 7 is a graph showing a relation among the diameter, the birefringence and the laser power density of drawn polyethylene terephthalate filaments in this invention;

5. DESCRIPTION OF THE PREFERRED EMBODIMENTS

Figure 1:
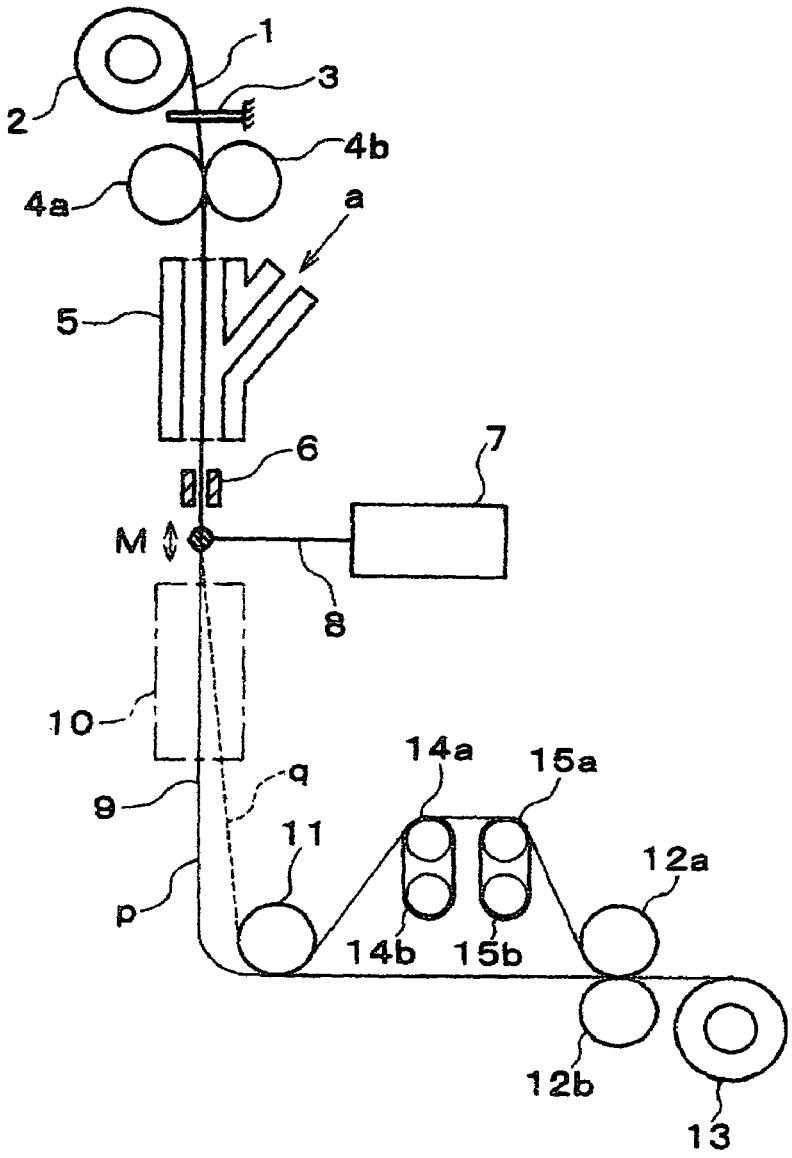
FIG. 1 is a schematic view of the process for manufacturing drawn filaments according to this invention.

Example of preferred embodiments of this invention are to be described with reference to the drawings. FIG. 1 shows an example of the process for manufacturing drawn filaments according to this invention. The original filament 1 is reeled off from a state wound around a reel 2, passed by way of a comb 3 and delivered at a constant speed from reel off nip rollers 4*a* and 4*b*. The supplied original filament 1 is sent by a blowing duct 5 and then falls down at a constant speed while being regulated for the position by a guiding tool 6. The blowing duct 5 is adapted such that air guided along an arrow "a" is introduced to a channel of the original filament 1 and the filament is sent by the flow of air. The guiding tool 6 is used for accurately determining the laser radiation position and the running position of the filament. While a hypodermic needle with an inner diameter 0.5 mm was used in the drawing, a narrow pipe, a comb or a snail-wire shown in FIG. 3 can also be used. A laser beam 8 is irradiated to a heating zone M of a predetermined width by a laser emitter 7 to the running original filament 1 just below the guiding tool 6. The filament is drawn and falls down as a drawn filament 9 by the tension given by the own weight of the filament heated by the laser beam 8 and the velocity of flow of the air delivered from the blowing duct. It is preferred that the filament passes through a heat treatment zone 10 formed in the falling path. The drawn filament 9 passes along a tackle 11 and then wind-up by way of take-up nip rolls 12*a* and 12*b* around a wind-up reel 13. In this case, the channel of the drawn filament 9 to the tackle 11 includes a case where it is drawn as a trace p of a free falling of the filament, a case where it is drawn as a linear trace q to the tackle 11 and a case where it is drawn as an intermediate trace thereof. In a case where it is drawn by the own weight of the drawn filament 8 in the trace p, the flow of air from the blowing pipe 5 is sometimes added to the drawing tension, which is also included within a category of drawing by own weight. In the trace q and at the intermediate position between the trace p and trace q, the wind-up tension exerts on the drawing tension in which the drawing tension is preferably 1 MPa or less. The drawing tension may be measured by a tension measuring mechanism disposed to the tackle 11 but as an another method, it can be estimated based on the relation of the same supplying speed as present invention, the laser irradiation condition and the draw ratio in the batchwise method described in the specification of Japanese Patent Application No. 2001-352781. Before wind-up by the take-up roll 12, the filament can be further drawn by a speed ratio between the drawing rolls 14 and 15 at the position between the heated drawing rolls 14*a* and 14*b* and the drawing rolls 15*a* and 15*b*. The heat treatment zone 10 for the filament in this case is preferably disposed subsequent to the drawing roller 15.

Figure 2A:
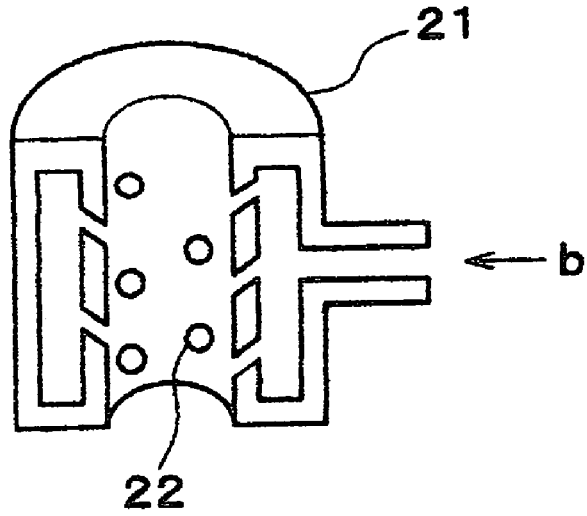
FIG. 2A is a cross sectional view showing an example of a blowing duct according to this invention in a case of a double-walled pipe.
Figure 2B:
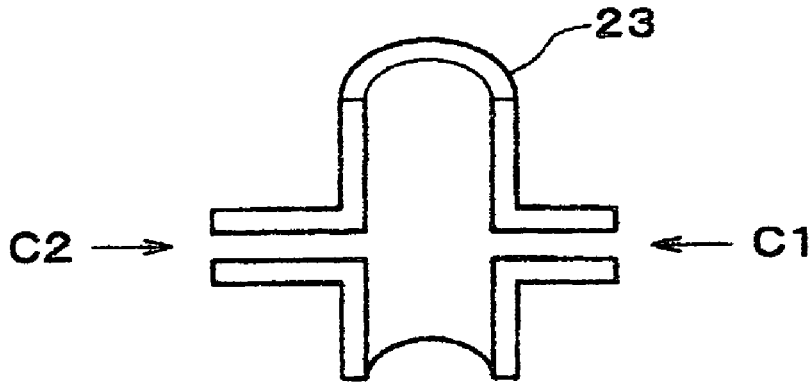
FIG. 2B is a cross sectional view showing an example of a blowing duct according to this invention in a case of the pipe is branched.

FIG. 2 shows examples of various blowing ducts adopted in this invention. FIG. 2A shows a double walled duct 21 in which the inside is made hollow and air introduced along an arrow "b" is guided through a number of apertures 22 perforated in the inner wall of the double walled duct to the channel of the filament. The aperture 22 is preferably inclined in the running direction of the filament. Both in the blowing duct 5 in FIG. 1 or the double wall duct 21 in FIG. 2A, air is flown positively in the running direction of the filament, so that the running of the filament is not deteriorated by the resistance of the guiding tool or the like since the drawing tension is small. FIG. 2B shows an example of an air interlace nozzle 23 used for interlace spinning in which an example of blowing air from both sides c1 and c2 is illustrated. Yet, as the blowing duct, not only the tubular shape shown in the drawing but also those having a grooved shape which is partially opened and adapted to easily pass the filament therethrough also can be used.

Figure 3:
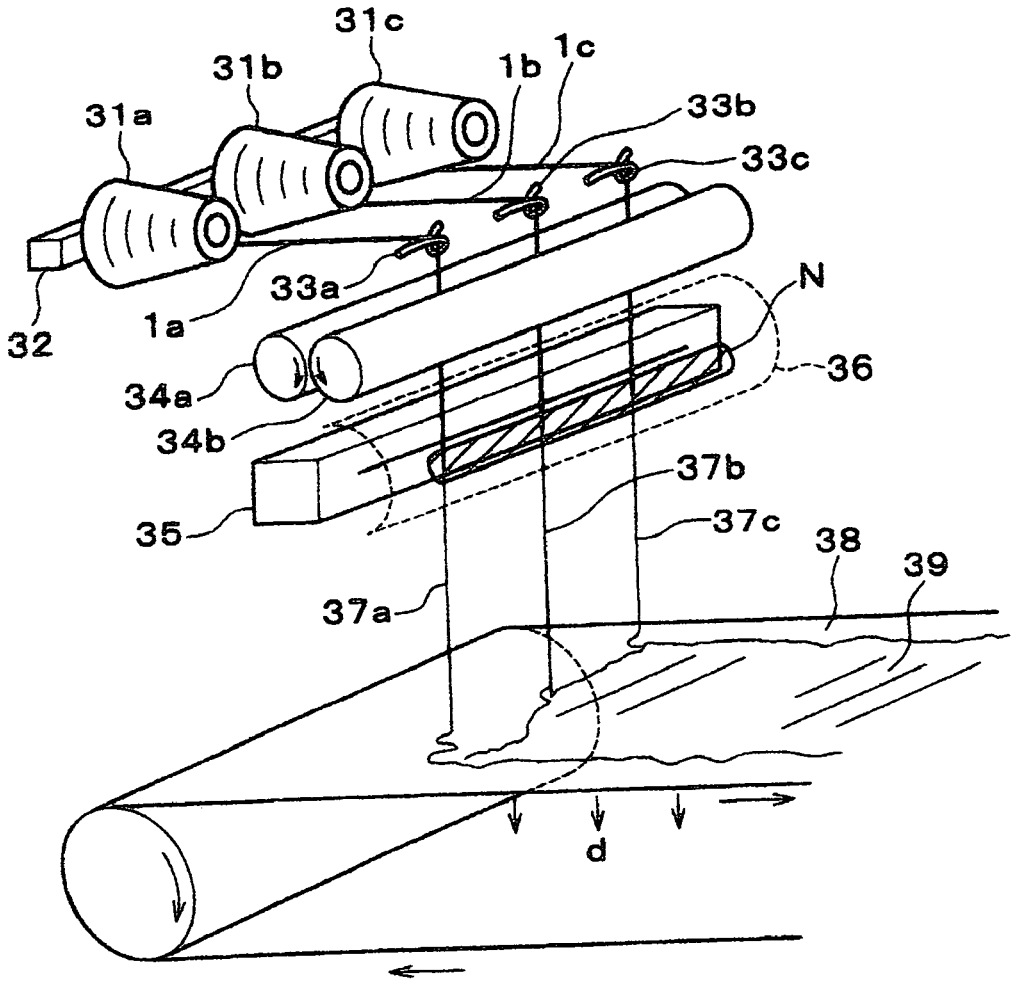
FIG. 3 is a schematic view of a process for manufacturing non-woven fabrics consisting of drawn filaments according to this invention.

FIG. 3 shows an example of manufacturing non-woven fabrics of this invention. A multiplicity of original filaments 1 are attached to a rack 32 in a state wound around bobbin 31 for avoiding complexity, only three filaments are shown). The original filaments 1*a*, 1*b* and 1*c* are delivered through snail wires 33*a*, 33*b* and 33*c* as the guiding tool by the rotation of the supply nip rolls 34*a* and 34*b*. The supplied original filaments 1 are heated in the course of falling by their own weight, by line infrared beams emitted from an infrared emitter 35. The range for the heating portion "N" by the infrared beams in the running process of the original filaments 1 is shown by hatched lines. Beams passing through the original filaments 1 with no absorption are reflected at a concave mirror 36 shown by a dotted line and then returned to be condensed to the heating portion "N". A concave mirror is disposed also on the side of the infrared emitter 35 (in this case, the beam traveling portion from the infrared emitter has an open window), which is not illustrated in the drawing. The original filaments 1 are heated by radiation heat of infrared rays at the heating portion N, drawn by the own weight of the filaments per se by the portion therebelow and formed into drawn filaments 37*a*, 37*b* and 37*c*, which are accumulated on a running conveyor 38 to form a web 39. Air is sucked in the direction of an arrow d by vacuum suction from the rear face of the conveyor 37 to contribute to the stability of running of the web 39. The web is pulled by the tension of the negative pressure d exerting on the drawn filament 37 to contribute to the improvement of attenuation and the orientation degree of the filaments and such tension is also regarded as a portion of the tension caused by the own weight in this invention. Although not illustrated in the drawing, a number of bobbins 32 for the original filaments 1 are provided in a multi-stage along the running direction of the conveyor 38, and nip rolls 34 and infrared emitters are provided in a multi-stage to improve the productivity of the web 39. In a case of providing the supply nip rolls 34 in the multi-stage along the running direction, the infrared emitter 35 and the concave mirror 36 can also be utilized for several stages.

EXAMPLE 1

Figure 4:
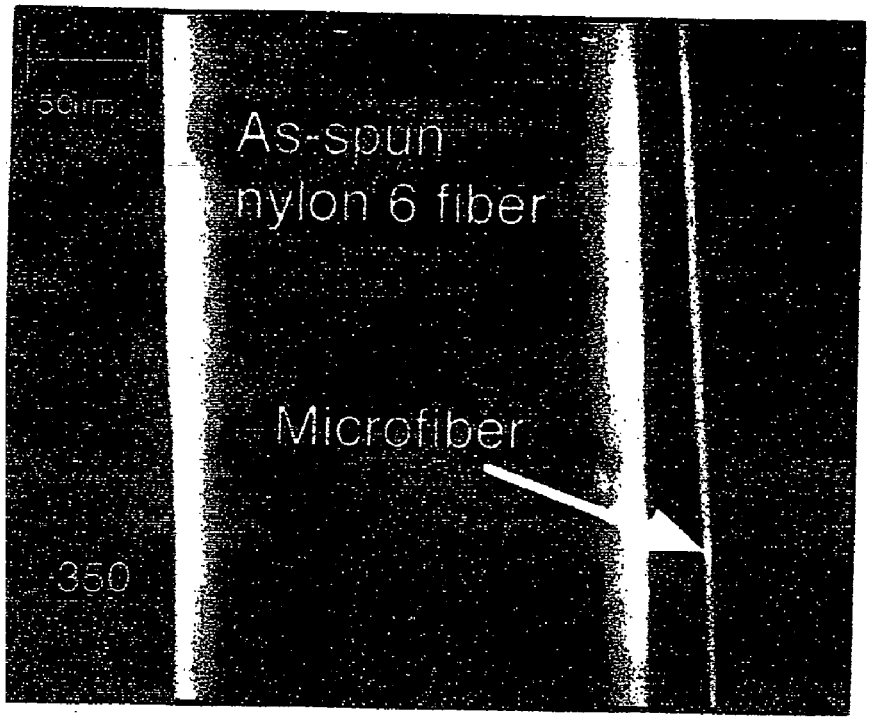
FIG. 4 is an electron microscopic photograph (350×) of original filaments for nylon 6 and drawn filaments drawn therefrom according to this invention.
Figure 5:
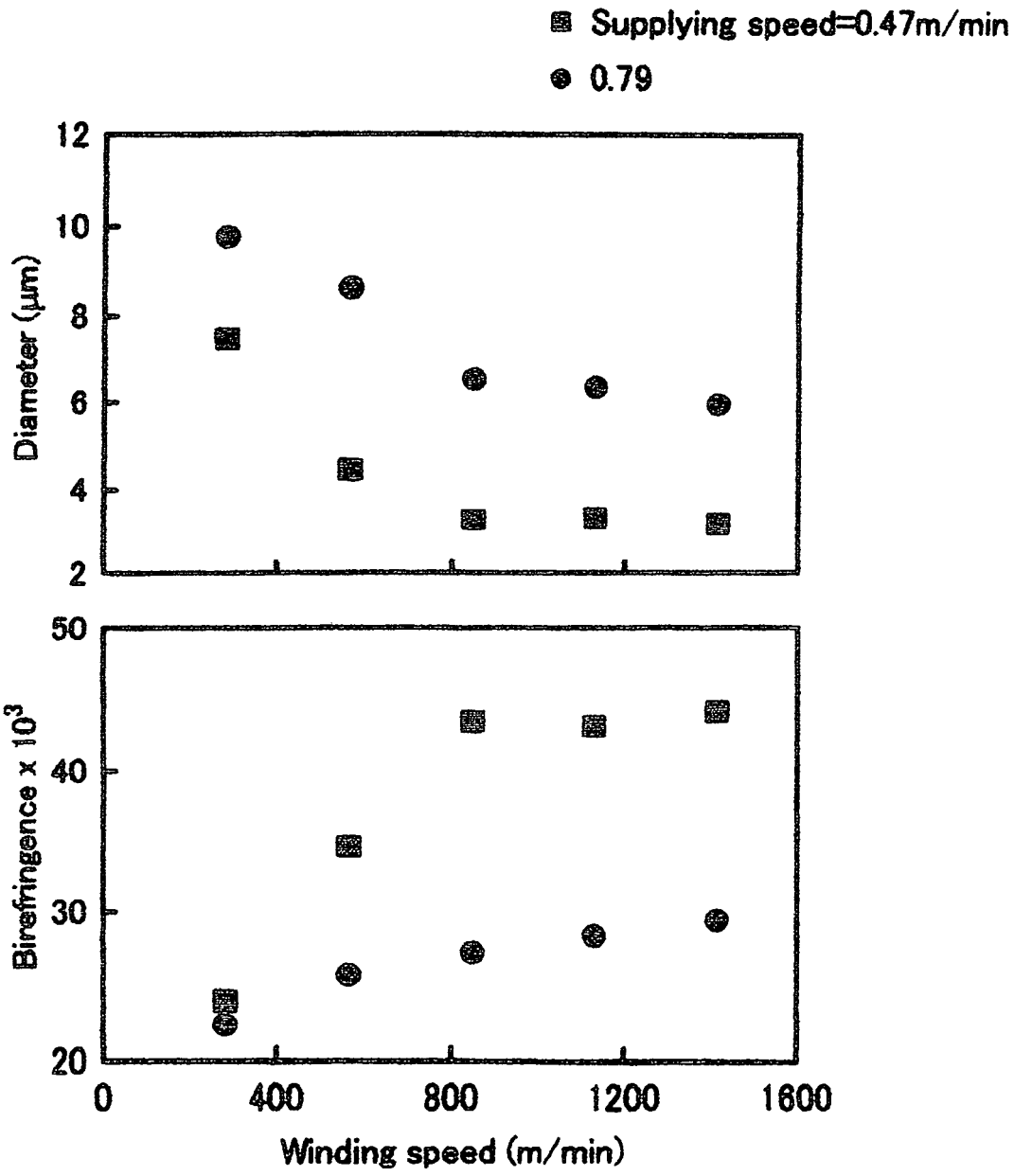
FIG. 5 is a graph showing a relation between the diameter and the birefringence of drawn nylon 6 filaments in this invention at a laser power density of 23.7 $W/cm^2$.
Figure 6:
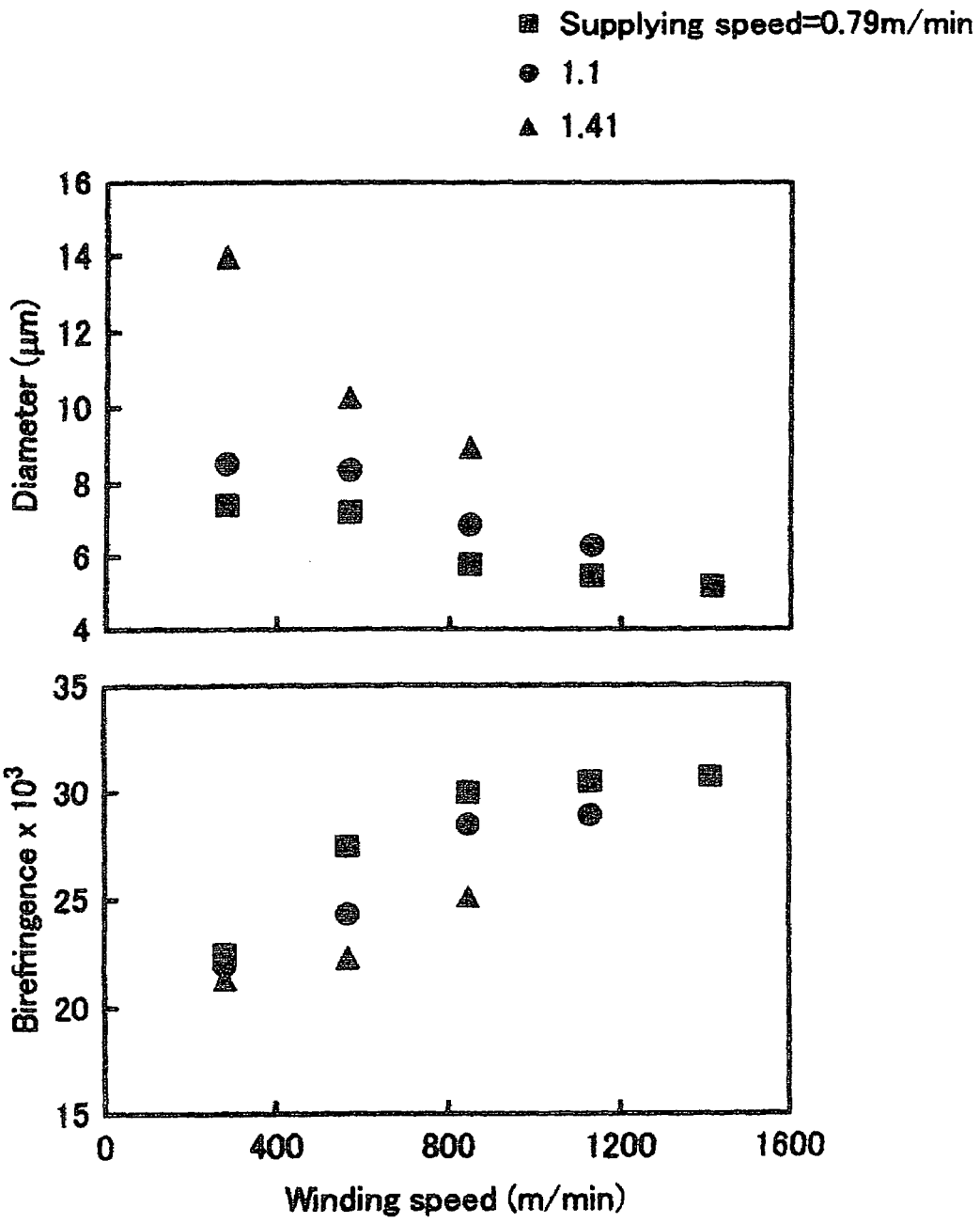
FIG. 6 is a graph showing a relation between the diameter and the birefringence of drawn nylon 6 filaments in this invention at a laser power density of 40.0 $W/cm^2$.

Undrawn nylon 6 filaments (diameter 185 μm, birefringence of $6.25\times10^{-3}$, degree of crystallinity of 27.6% (based on density by floatation technique) were used as original filaments and drawn by the apparatus shown in FIG. 1. The filaments were drawn at a supplying speed of 0.47 m/min and a wind-up speed of 1414 m/min. In this case, a carbon dioxide gas laser emitter manufactured by Onizuka Glass Co., Ltd. with a maximum power of 10 W was used for the laser emitter. The laser power density was 23.7 W/cm$^2$ and the beam diameter was 4.0 mm. The drawn filaments ran along the trace p in FIG. 1 and the distance from the laser-heating portion M to the lowermost position was 150 cm. The obtained drawn filament had a diameter of 3.16 μm (draw ratio: 3427) and a birefringence of $44.12\times10^{-3}$. Comparison between the original filament and the drawn filament is shown by a scanning electron microscopic (SEM) photograph of FIG. 4. FIGS. 5 and 6 show a relation between the diameter and the birefringence in a case of changing the supplying speed and the wind-up speed variously. FIG. 5 shows a case at a laser power density of 23.7 W/cm$^2$ and FIG. 6 shows a case at a laser power density of 40 W/cm$^2$.

EXAMPLE 2

Undrawn polyethylene terephthalate filaments (diameter of 240 μm, birefringence of $0.5\times10^{-3}$, amorphous and isotropic state were confirmed by wide angle X-ray diffraction photography) were used and drawn by the apparatus shown in FIG. 1. The laser emitter is identical with that in Example 1. The filaments were drawn at a supplying speed of 0.30 m/min and a wind-up speed of 1400 m/min. In this case, the laser power density was 1.91 W/cm$^2$ and the beam diameter was 4.0 mm. The drawn filaments ran along the trace q in FIG. 1 and the drawing tension at that time was 0.45 MPa when estimated from the batchwise system in the prior application. The obtained drawn filament had a diameter of 3 μm (draw ratio: 6400) and a birefringence of $38.0\times10^{-3}$. Table of FIG. 7 shows a relation between diameters, a birefringence and a laser power density in a case of changing the supplying speed and the take-up speed variously for the original filaments.

EXAMPLE 3

Figure 8:
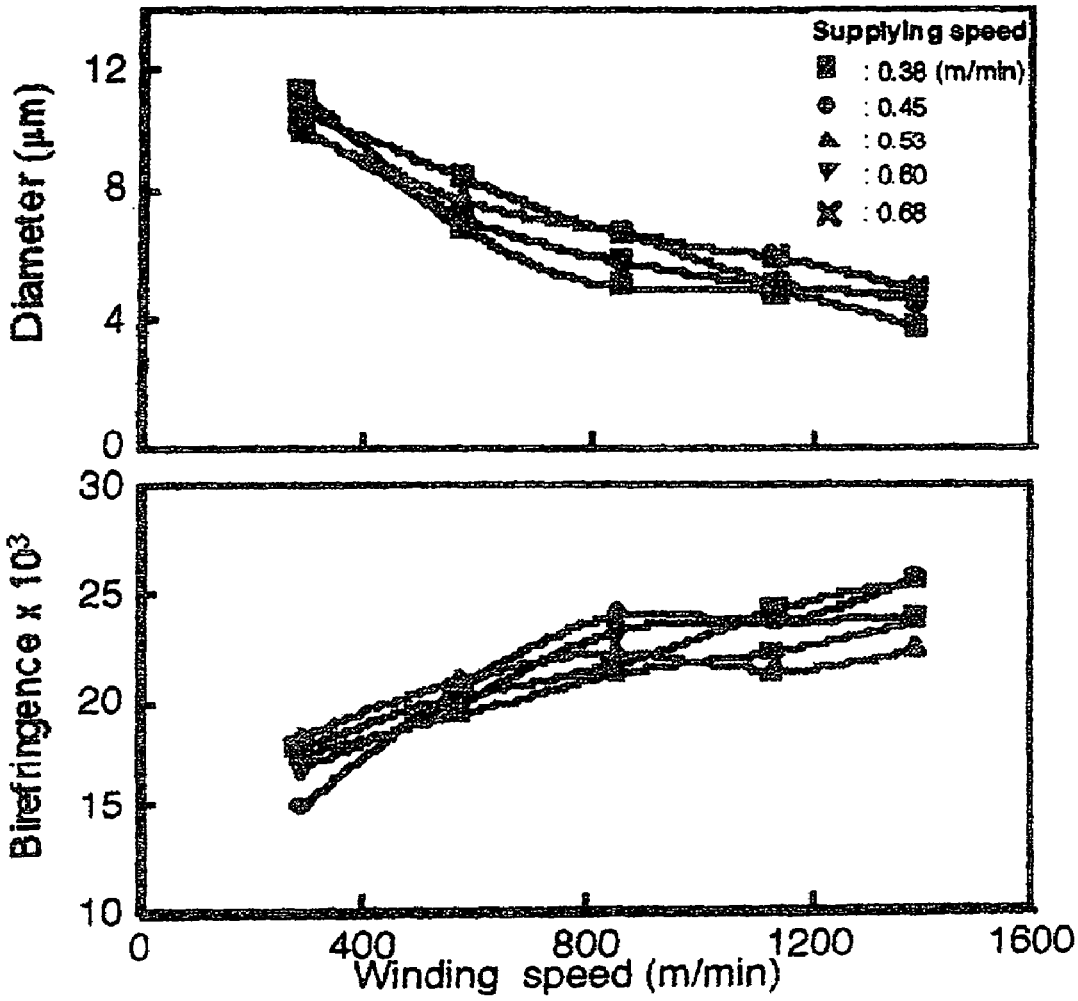
FIG. 8 is a graph showing a relation between the diameter and the birefringence of drawn polypropylene filaments in this invention.

Undrawn isotactic (it) polypropylene filaments (diameter of 211.0 μm, a birefringence of $0.3\times10^{-3}$ and a degree of crystallinity of 47%) were used as original filaments and drawn by the apparatus shown in FIG. 1. The original filaments were obtained by melt spinning from pellets of Ace Polymer Co., Ltd. ($Mw=3\times10^5$, $Mw=5\times10^4$) The laser emitter is identical with that in Example 1. The filaments were drawn at a supplying speed of 0.38 m/min and at a wind-up speed of 1386.9 m/min. The drawn filaments ran along a trace q in FIG. 1 and the drawing tension in this case was 0.33 MPa as estimated from the batchwise system in the prior application. The obtained drawn filament had a diameter of 3.8 μm (draw ratio: 3082), and a birefringence of the filament was $25.6\times10^{-3}$. For the original filaments, FIG. 8 shows a relation between the diameter and the birefringence in a case of changing the supplying speed and the wind-up speed variously.

EXAMPLE 4

Figure 9:
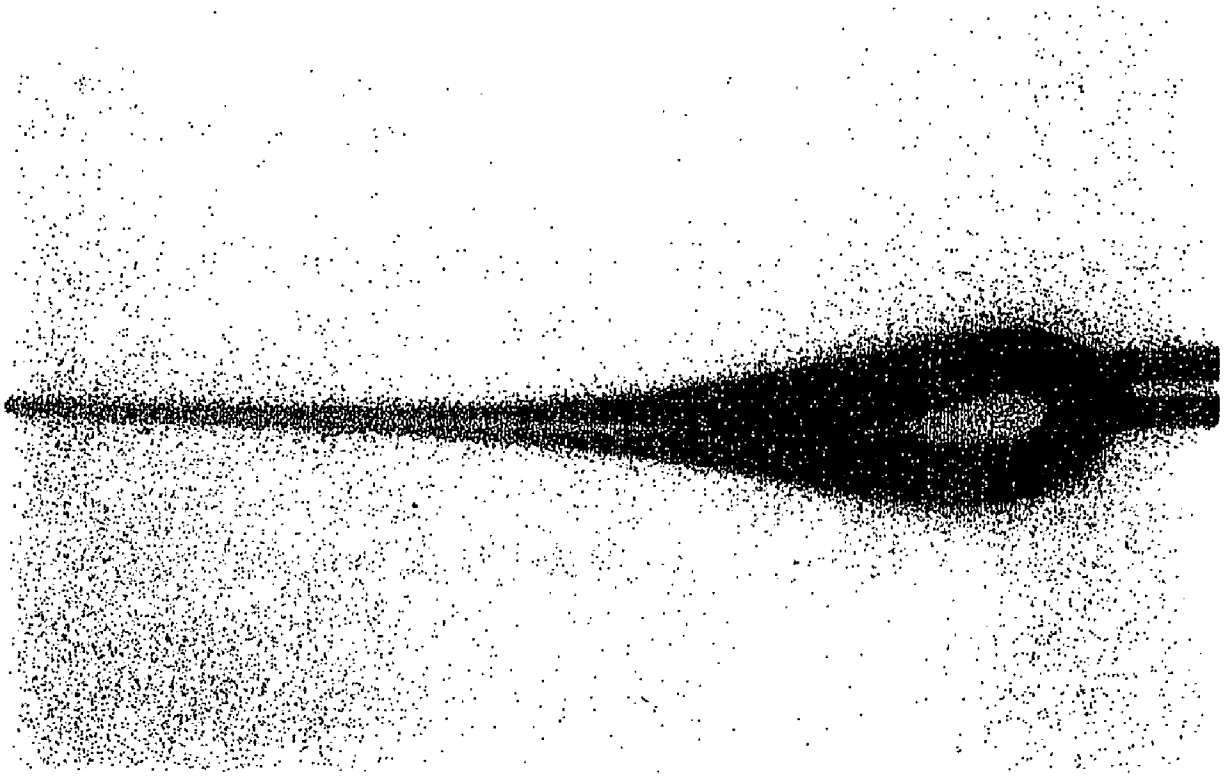
FIG. 9 is an optical microscopic photograph (20×) of a filament showing a drawing state accompanying with a swelled portion of this invention.

The same polymer as in Example 3 was used to spin filaments of 408.6 μm which was subjected to zone drawing at a ratio of 9.7 at a drawing temperature of 140° C. to prepare original filaments (in this case, filament diameter was 134.1 μm, the birefringence was $34.0\times10^{-3}$ and degree of orientation in view of the birefringence is 81.0) and drawn in accordance with FIG. 1. In the initial stage of drawing, the original filaments were abruptly swelled to a diameter three times or more the diameter of the original filaments and then the fiber diameter was decreased (FIG. 9) and, finally, super micro filaments of 2 μm with a birefringence of $28\times10^{-3}$ could be obtained finally (draw ratio: 4489). The drawn filaments ran along the trace q in FIG. 1 and the drawing tension in this case was estimated as 0.25 MPa based on the batch system in the prior application. In the drawing the original filaments with the birefringence of $11.8\times10^{-3}$ (degree of orientation of 28% in view of birefringence), no remarkable expanding phenomenon was obtained.

Although a certain preferred embodiments of the present invention have been shown and described in detail, it should be understood that various changes and modifications may be made without departing form the spirit or scope of the appended claims.

6. INDUSTRIAL APPLICABILITY

This invention intends to continuously obtain super microfilaments easily by a simple and convenient method without requiring any special apparatus of high accuracy and high level. This invention further intends to enable stable production of highly oriented super micro filaments with a diameter of 5 μm or less from most of thermoplastic polymers.

This invention further intends to provide means for realizing the drawing at a super high draw ratio of 1000 times or more, which can provide super micro filaments simply and conveniently, as well as means to be able to produce drawn filaments at a high speed thus having a significant effect with a view point of productivity. Such highly oriented super micro filaments can be used not only in the fields such as for artificial leather, wiping cloths and air filters for which super micro filaments have been used so far but also for the fields such as base cloths for screen printing, air bags and tire cords for automobiles.

This invention further intends to manufacture antibacterial fiber products, as super micro filaments of this invention are super micro size such as from 2 μm to 3 μm and to be able to make filaments having smooth surface, they can be used as garments such as surgery cloths or various antibacterial goods by utilizing the antibacterial property.

This invention further intends to enable the manufacture of long fiber non-woven fabrics comprising highly oriented super microfilaments. As commercially available non-woven fabrics consisting of super micro filaments, there are melt-blown non-woven fabrics, but they lack in filaments strength and require reinforcing nets and are mixed with small resin lumps called shot. The non-woven fabrics of this invention intend to provide lustrous non-woven fabrics consisting of super microfilaments, highly oriented filaments, having favorable strength and free of shots. The non-woven fabrics of this invention can be used as high performance filters by applying an electrostatic treatment. Further, since the diameter is small, the number of filaments per unit area can be increased extremely that they can be used as non-woven fabrics for packaging use with good printability.

This invention has been accomplished for attaining the foregoing purposes and provides a method of manufacturing drawn filaments, which characterizes in heating of original filaments delivered from filaments supply device by infrared beams and the heated filaments are drawn by a tension provided by their own weight.

In a preferred embodiment of this invention for a method of manufacturing drawn filaments, the original filaments delivered from the filament supply device are heated by the infrared beams and the heated filaments are drawn under an applied tension of 1 MPa or less. In this case, it is preferred to conduct heating within a range of the infrared beams of 8 mm or less and the infrared beams are preferably laser beams. Further, it is preferred that the filaments are sent by blowing duct before the filaments are heated by the infrared beams. Further, it is preferred to provide a guiding tool for controlling the position of the filaments before they are heated by infrared beams.

Further, in a preferred embodiment of this invention for the method of manufacturing drawn filaments, the original filament is preferably any one of filaments of polyethylene terephthalate, nylon and polypropylene, and the draw ratio of the drawn filament is 1000 times or more. Further, it is preferred that the original filament has a degree of orientation of 30% or more when estimated form birefringence, it is drawn with an swelled portion larger than the diameter of the original filament at the starting point for drawings and, further, the drawn filament thus obtained has a diameter of 5 μm or less.

Further, in a preferred embodiment of a method of manufacturing the drawn filaments according to this invention, the drawn filaments by above method are heated in a heating zone disposed subsequently and the drawn filaments are wound-up. It is further preferred that the drawn filaments by above method are wound-up after additional drawing.

Further, concerning the method of manufacturing non-woven fabrics consisting of drawn filaments according to this invention, the filaments drawn by the means of described above are formed to non-woven fabrics according to accumulate on a running conveyor.

Further, according to the preferred embodiment of the apparatus for manufacturing drawn filaments of this invention, by providing with the supply device for original filaments and an infrared beam emitter for heating the original filaments within a range of 8 mm or less, the heated filaments are drawn according to a tension given by their own weight or under an applied tension of 1 MPa or less. The infrared beam emitter is, preferably, a laser emitter and, further preferably, a carbon dioxide gas laser having a power density of 15 W/cm$^2$ or more.

Moreover in this invention, it is preferred to provide a further heating device having a heating zone, and heat treat the drawn filaments. Further, it is preferred to have filament wind-up means in the drawing device of the above filament. Also, an additional drawing device can also be provided to the apparatus for manufacturing the drawn filaments. Further, able to be the non-woven fabric manufacturing apparatus providing the running conveyor to above drawn filaments manufacturing apparatus on which the drawn filaments are accumulated.

Further, in a preferred embodiment of the apparatus for manufacturing drawn filaments of this invention, the blowing duct is disposed before heating of the original filaments by the infrared beams to deliver the original filaments through the blowing duct. Further, a guiding tool for controlling the position of the filaments is preferably disposed before heating the original filaments by the infrared beams.

Further, in a preferred embodiment of the drawn filaments according to this invention, it is characterized in that the drawn filaments have a draw ratio of 1000 times or more and, further, the drawn filaments are drawn with a swelled portion larger than the diameter of the original filaments at the drawing start portion.

Further, in a preferred embodiment of the drawn filaments according to this invention, the above drawn filaments are nylon 6 or nylon 66, which are highly oriented super micro filaments with a birefringence of $35\times10^{-3}$ or more and a diameter of 5 μm or less. Also, it is preferred that the drawn filaments are polyethylene terephthalate, which are highly oriented super micro filaments with the birefringence of $30\times10^{-3}$ or more and the fiber diameter of 5 μm or less. Further, it is preferred that the drawn filaments are isotactic polypropylene, which are highly oriented super micro filaments with the birefringence of $20\times10^{-3}$ or more and a diameter of 5 μm or less.

The above and other objects, features and advantages of the present invention will become apparent from the following description with reference to the accompanying drawing, which illustrates an example of the present invention.

The invention claimed is:

1. A method of manufacturing drawn filaments which comprises heating original filaments supplied from a filament supply means by infrared beams, drawing the filaments to 1000 times or more under a tension provided by the own weight of the filaments, or under a tension of 1 Mpa or less, and having a degree of orientation of 20.8% or more in view of birefringence for the drawn filaments.

2. A method of manufacturing drawn filaments according to claim 1, wherein original filaments are heated by infrared beams within a range of 8 mm or less.

3. A method of manufacturing drawn filaments according to claim 1, wherein filaments are delivered from a blowing duct before the filaments are heated by infrared beams.

4. A method of manufacturing drawn filaments according to claim 1, wherein the original filaments have a degree of orientation of 30% or more when measured in view of a birefringence and are drawn with a swelled portion larger than the diameter of the original filaments at the drawing start point.

5. A method of manufacturing drawn filaments according to claim 1, wherein the obtained drawn filaments have a diameter of 5 μm or less.

6. A method of manufacturing drawn filaments according to claim 1, wherein the drawn filaments are heated in a heating zone disposed subsequently.

7. A method of manufacturing drawn filaments according to claim 1, wherein the drawn filaments are further drawn and then wound up.

8. A method of manufacturing non-woven fabrics comprised of drawn filaments according to claim 1, wherein the drawn filaments are accumulated on a running conveyor.

9. An apparatus for manufacturing drawn filaments comprising a supply device for original filaments, a guiding device to regulate a position of filaments before the original filaments are heated by infrared beams, an infrared beam emitter for heating the original filaments within a range fo 8 mm or less, and means to control a drawing tension to draw 1000 times or more the original filaments by tension provided by their own weight or tension of 1 Mpa or less.

10. An apparatus for manufacturing drawn filaments according to claim 9, wherein the infrared beam emitter is a laser emitter.

11. An apparatus for manufacturing drawn filaments according to claim 10, wherein the laser beam is a carbon dioxide gas laser having a power density of 15 W/cm$^2$ or more.

12. An apparatus for manufacturing drawn filaments according to claim 9, wherein a heating device having a heating zone is provided to the drawing means and the drawn filaments are heated.

13. An apparatus for manufacturing drawn filaments according to claim 9, wherein a drawing means is further provided for manufacturing drawn filaments.

14. An apparatus for manufacturing non-woven fabrics comprised of drawn filaments according to claim 9, comprising a running conveyor on which drawn filaments are accumulated.

15. An apparatus for manufacturing drawn filaments according to claim 9, wherein a blowing duct is disposed before the original filaments are heated by the infrared beams, and the original filaments are delivered by the blowing duct.

16. A highly oriented super micro filament in which the drawn filaments according to claim 1 are nylon 6 or nylon 66 and have the birefringence of $35\times10^{-3}$ or more and the fiber diameter of 5 μm or less.

17. A highly oriented super micro filament in which the drawn filaments according to claim 1 are polyethylene terephthalate and have the birefringence of $30\times10^{-3}$ or more and a diameter of 5 μm or less.

18. A highly oriented super micro filament in which the drawn filaments according to claim 1 are isotactic polypropylene and have the birefringence of $20\times10^{-3}$ or more and a diameter of 5 μm or less.

* * * * *